US009458864B2

(12) United States Patent
Hyon et al.

(10) Patent No.: US 9,458,864 B2
(45) Date of Patent: Oct. 4, 2016

(54) HYDRAULIC DRIVE CIRCUIT

(71) Applicants: The Ritsumeikan Trust, Kyoto (JP); Mori Kogyo Co., Ltd., Shizuoka (JP)

(72) Inventors: Sang-Ho Hyon, Shiga (JP); Harutsugu Mizui, Chiba (JP); Etsuhiro Mori, Shizuoka (JP)

(73) Assignees: THE RITSUMEIKAN TRUST, Kyoto-Shi, Kyoto (JP); MORI KOGYO CO., LTD., Shizuoka-Shi, Shizuoka (JP)

( * ) Notice: Subject to any disclaimer, the term of this patent is extended or adjusted under 35 U.S.C. 154(b) by 0 days.

(21) Appl. No.: 14/241,411

(22) PCT Filed: Jul. 23, 2013

(86) PCT No.: PCT/JP2013/069900

§ 371 (c)(1),
(2) Date: Feb. 26, 2014

(87) PCT Pub. No.: WO2014/017475

PCT Pub. Date: Jan. 30, 2014

(65) Prior Publication Data

US 2015/0121860 A1 May 7, 2015

(30) Foreign Application Priority Data

Jul. 25, 2012 (JP) ..... P2012-164773

(51) Int. Cl.
*F15B 13/02* (2006.01)
*F15B 11/17* (2006.01)
(Continued)

(52) U.S. Cl.
CPC ..... *F15B 13/021* (2013.01); *F15B 11/17* (2013.01); *F15B 13/0401* (2013.01); *F15B 7/006* (2013.01);
(Continued)

(58) Field of Classification Search
CPC .. F15B 13/021; F15B 11/02; F15B 13/0401; F15B 11/17; F15B 2211/75
See application file for complete search history.

(56) References Cited

U.S. PATENT DOCUMENTS 3,906,727 A * 9/1975 Hull ..... F16H 39/02 60/403
6,886,332 B2 * 5/2005 Kubinski ..... F15B 7/08 60/475
8,720,197 B2 * 5/2014 Persson ..... E02F 9/2217 60/456
(Continued)

FOREIGN PATENT DOCUMENTS

JP 58-46256 3/1983
JP 2006-292067 10/2006
(Continued)

OTHER PUBLICATIONS

International Search Report and Written Opinion for PCT/JP2013/069900.

*Primary Examiner* — Thomas E Lazo
*Assistant Examiner* — Abiy Teka
(74) *Attorney, Agent, or Firm* — McClure, Qualey & Rodack, LLP

(57) ABSTRACT

A hydraulic drive circuit is provided that can achieve high responsiveness, high precision, and high efficiency at a low cost in a hydraulic drive system popularly used in an industrial machine such as a press machine, a construction machine, and the like.

A hydraulic drive circuit 1 supplies pressured liquid discharged from a main hydraulic pump P to drive a hydraulic actuator 2, and includes a first valve 4 arranged in a main flow line 3 that circulates pressured liquid discharged from the main hydraulic pump P to the hydraulic actuator 2, a second valve 5 to return the pressured liquid flowing into one liquid chamber of the hydraulic actuator 2 and discharged from the other liquid chamber to a tank T, and a sub-hydraulic pump 7 that is arranged between the main hydraulic pump P and the drive direction control valve 4 and uses the pressured liquid flowing in a branched flow line 6 branched from the main flow line 3 to increase a pressure and a volume of the hydraulic liquid in the main flow line 3 by predetermined quantities, respectively.

2 Claims, 5 Drawing Sheets

(51) Int. Cl.
*F15B 13/04* (2006.01)
*F15B 7/00* (2006.01)

(52) U.S. Cl.
CPC ..... *F15B 2211/20515* (2013.01); *F15B 2211/20561* (2013.01); *F15B 2211/20569* (2013.01); *F15B 2211/20576* (2013.01); *F15B 2211/27* (2013.01); *F15B 2211/3058* (2013.01); *F15B 2211/30565* (2013.01); *F15B 2211/30575* (2013.01); *F15B 2211/31558* (2013.01); *F15B 2211/327* (2013.01); *F15B 2211/7054* (2013.01); *F15B 2211/75* (2013.01); *F15B 2211/76* (2013.01)

(56) References Cited

U.S. PATENT DOCUMENTS

2007/0277883 A1* 12/2007 Asakage ..... E02F 9/128 137/485
2008/0250783 A1* 10/2008 Griswold ..... F15B 7/006 60/422

FOREIGN PATENT DOCUMENTS

JP 2007-298073 11/2007
JP 2010-174883 8/2010

* cited by examiner

HYDRAULIC DRIVE CIRCUIT

TECHNICAL FIELD

The present invention relates to a hydraulic drive circuit used in a hydraulic (oil pressure, water pressure, or the like) drive machine and, in particular, to a hydraulic drive circuit that is preferably applied to a servo application required to have high precision and high responsiveness.

BACKGROUND ART

Conventionally, techniques such as an "oil hydraulic hybrid" technique and an "oil hydraulic servo" technique are known. There are oil hydraulic hybrid techniques roughly classified into two types as described in Non-Patent Document 1. One of the types is, in place of a conventional oil hydraulic servo system having low efficiency, a hybrid oil hydraulic system that drives a conventional oil hydraulic pump with an inverter drive motor or a servo motor to make it possible to perform valve control without generating wasteful energy. This system is popularly prevalent in the industrial circles.

The other is of a type in which excessive mechanical energy is regenerated into a battery through an electric motor mainly and that is mainly used in an automobile or a construction machine. Such a type is also called a hybrid type. In particular, since hybrid automobiles are explosively popularized in the automotive industry, in general, it is strongly recognized that a hybrid means complex use of petroleum and an electric motor. However, as described in Non-Patent Document 2, an oil hydraulic hybrid automobile is researched or developed overseas. This means a technique that uses an oil hydraulic motor and an accumulator in place of an electric motor and a battery, respectively, to accumulate mechanical (fluid) energy obtained in a braking state or the like. The object of the technique is just energy regeneration. The technique is different from a technique used in the present invention (will be described later).

As a technique related to the present invention, an oil hydraulic servo system is given (this servo system mentioned here means a system to automatically track target values such as a position, a speed, and a power). The hydraulic servo systems, as described in Non-Patent Document 3, can be classified into a conventional valve control type having a constant pressure and a constant discharge rate and a relatively recently developed pump control type. A popularly used inexpensive oil hydraulic drive circuit is configured by an open circuit that generates pressured oil with a main pump, restricts the pressured oil with a valve to drive an actuator, and returns the pressured oil to a tank. A typical example of a valve control type servo system is a system that uses a high-performance proportional valve and a servo valve to improve the responsiveness and precision of an actuator. A typical example of a pump control type servo system is a system that is improved in efficiency by performing load sensing drive of a variable displacement pump or controlling the rotating speed of a fixed displacement pump with an inverter motor or a servo motor. As described in Non-Patent Document 4, an oil hydraulic drive circuit in which two or more pumps are serially coupled to each other to obtain a pressure-increasing effect is also given.

PRIOR ART DOCUMENTS

Non-Patent Documents

Non-Patent Document 1: Special Topic "Technical Trend on Hydraulic Hybrid System" by Nishiumi Takao, Tanaka Yutaka, et al., Journal of the Japan Fluid Power System Society Vol. 41, no. 4, pp. 182 to 253, 2010.

Non-Patent Document 2: Karl-Erik Rydberg, Hydraulic hybrids—the new generation of energy efficient drives, Proc. of ISFP, pp. 899 to 905, 2009.

Non-Patent Document 3: LU Jinshi, LIU Canghai, SAITO Michihito, et al. "A Study on N-level Pressure Power Supply and its Application in High Response and High Efficiency Hydraulic Servo System (1st Report) Proposal of N-level Pressure Hybrid Power Supply and its Effectiveness in Improving Efficiency", Journal of the Japan Fluid Power System Society, Vol. 42, no. 3, pp. 46 to 52, 2011.

Non-Patent Document 4: Parallel Circuit and Series Circuit, Hydraulics & pneumatics handbook, New Edition, Edited by Japan Hydraulics & Pneumatics Society, pp. 109 to 110

SUMMARY OF THE INVENTION

Problems to be Solved by the Invention

However, since the valve control type oil hydraulic servo system uses a high-performance servo valve, an introduction cost and a running cost (thermal loss caused by throttling-off, or a failure caused by clogging) are very high. Since the pump control type need only be required to change only a basic oil pressure source, an energy saving effect can be obtained with a small amount of labor for construction. However, responsiveness equivalent to that of the valve control type cannot be achieved without using a servo valve. Furthermore, a large-capacity inverter servo motor has a high cost. In addition, as a technique obtained by more specializing the above concept for a servo application, as described in Non-Patent Document 1, an electric hydraulic actuator (EHA) in which a pump and an actuator are arranged with one-to-one correspondence is known. However, this circuit is not an open circuit, but is the same closed circuit configuration as that of a hydro static transmission (HST) popularly used in a construction machine. For this reason, the introduction of the circuit approximately means complete replacement of systems, and the introduction cost is high. In an application having sharply varying loads, responsiveness and precision equivalent to those in the valve control type using a servo valve are difficult to be compatible. As described in Non-Patent Document 4, an old hydraulic drive circuit in which a plurality of pumps are simply serially coupled with each other can obtain only a pressure-increasing effect, and the cost increases.

The present invention has been made in consideration of the above various problems, and an object thereof is to provide a hydraulic drive circuit that can achieve high responsiveness, high precision, and high efficiency at a low cost in a hydraulic drive system popularly used for mobile purposes in an industrial machine such as a press machine, or a construction machine, or the like.

Solutions to the Problems

In order to achieve this object, a hydraulic drive circuit described in claim 1 that drives a hydraulic actuator by supplying pressured liquid discharged from a main hydraulic pump, is characterized by including a first valve arranged in a main flow line that branches the pressured liquid discharged from the main hydraulic pump in two directions and circulates the pressured liquid into liquid chambers of the hydraulic actuator to switch drive states of the hydraulic actuator, a second valve to return to a tank the pressured liquid flowing from the main flow line into one of the liquid chambers of the hydraulic actuator and discharged from the other liquid chamber, and a sub-hydraulic pump that is arranged between the main hydraulic pump and the direction control valve in a branched piping route branched from the main flow line and uses the pressured liquid flowing in the branched flow line to increase a pressure and a volume of the pressured liquid supplied from the main flow line to the hydraulic actuator by predetermined quantities, respectively.

The hydraulic drive circuit described in claim 2 is characterized in that the sub-hydraulic pump, the first valve, and the second valve are integrally configured by a manifold.

A hydraulic drive circuit described in claim 3 includes a plurality of hydraulic drive circuits, each of which is recited in claim 1 or 2, and is characterized in that the main flow line is branched such that pressured liquid discharged from the main hydraulic pump is circulated to the respective hydraulic drive circuits.

Effects of the Invention

According to the hydraulic drive circuit described in claim 1, since the sub-hydraulic pump can increase the pressure and volume of the pressured liquid supplied from the main flow line to the hydraulic actuator by the predetermined quantities, respectively, responsiveness and precision of control of the power and speed of the hydraulic actuator can be improved. Furthermore, since the sub-hydraulic pump and the first valve are arranged between the conventional main hydraulic pump and the hydraulic actuator, high performance can be easily achieved at a low cost.

According to the hydraulic drive circuit described in claim 2, since the sub-hydraulic pump, the first valve, and the second valve are integrally configured by the manifold, a small size and a light weight can be achieved.

According to the hydraulic drive circuit described in claim 3, all the loads are covered with one main flow line, variations of the hydraulic actuators are covered with the sub-hydraulic pump, so that a machine on the liquid actuator side can be considerably reduced in size and weight. For this reason, the hydraulic drive circuit can be advantageously used in a drive system of a construction machine or the like. In addition, since maintenance management of the hydraulic drive circuit can be divided between a main circuit on which the main hydraulic pump is arranged and a circuit on the hydraulic actuator side on which the sub-hydraulic pump, the first valve, the second valve, and the like are arranged, an introduction cost and a maintenance cost can be considerably reduced.

EMBODIMENTS OF THE INVENTION

A hydraulic drive circuit 1 according to a first embodiment of the present invention will be described below with reference to the drawings. The hydraulic drive circuit 1 supplies pressured liquid discharged from a main hydraulic pump P to drive and control a double rod cylinder (hydraulic actuator) 2.

Figure 1:
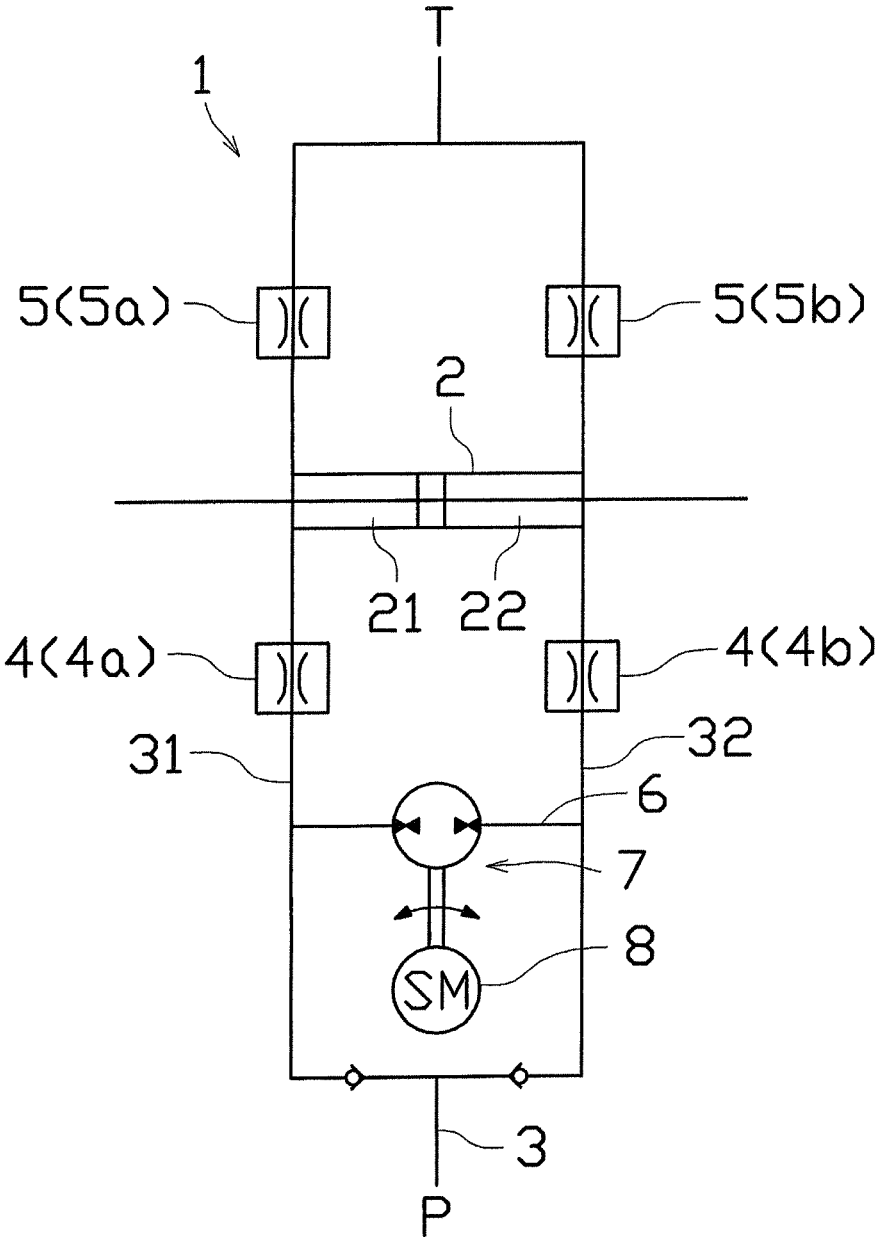
FIG. 1 is a hydraulic circuit diagram schematically showing a configuration according to a first embodiment of the present invention.

The hydraulic drive circuit 1, as shown in FIG. 1, includes left and right first valves 4 (4*a* and 4*b*) arranged in a main flow line 3 that branches pressured liquid discharged from the main hydraulic pump P in two directions and circulates the pressured liquid into respective liquid chambers 21 and 22 of the double rod cylinder 2, left and right second valves 5 (5*a* and 5*b*) to return the pressured liquid discharged from the double rod cylinder 2 to a tank T, and a bidirectional rotary hydraulic pump 7 that is arranged between the main hydraulic pump P and the first valves 4*a* and 4*b* in a branched flow line 6 branched from the main flow line 3. In the hydraulic drive circuit 1, although not shown in detail, a servo motor 8 to rotationally drive the sub-hydraulic pump 7, a computer control circuit to control operations of various valves or the like, a manual operational circuit, various sensors such as a pressure sensor, and the like are arbitrarily arranged.

The main hydraulic pump P is driven with an electric motor, an engine, or the like (not shown) to discharge high-pressured liquid to the main flow line 3. The main flow line 3, as shown in FIG. 1, is branched in two directions, and the branched ends are connected to the liquid chambers 21 and 22 of the double rod cylinder 2.

The left and right first valves 4*a* and 4*b* are arranged in left and right routes 31 and 32 of the main flow line 3, respectively. As the first valves 4*a* and 4*b*, direction control valves, flow control valves, pressure control valves, and the like can be used. For example, when direction control valves are used as the first valves 4*a* and 4*b*, the left and right first valves 4*a* and 4*b* are opened/closed to adjust a flow rate of pressured liquid supplied from the main flow line 3 into the left liquid chamber 21 or the right liquid chamber 22 of the double rod cylinder 2 so as to switch drive states (drive to the left or right) of the double rod cylinder. The second valves 5*a* and 5*b* are arranged to return to the tank the pressured liquid flowing from the main flow line 3 into one of the liquid chambers of the double rod cylinder 2 and discharged from the other liquid chamber. As the second valves 5*a* and 5*b*, direction control valves, flow control valves, pressure control valves, and the like can be used.

The sub-hydraulic pump 7 can be bidirectionally rotated with an electric motor such as the servo motor 8. The sub-hydraulic pump 7, as shown in FIG. 1, is arranged in the branched flow line 6 branched from the main flow line 3 (routes 31 and 32) and having both ends connected to the left route 31 and the right route 32, respectively. The sub-hydraulic pump 7 is rotationally driven with the servo motor 8 and uses the pressured liquid flowing in the branched flow line 6 to increase a pressure and a volume of the pressured liquid supplied from the main flow line 3 into one of the liquid chambers 21 and 22 of the double rod cylinder 2 by predetermined quantities, respectively.

The embodiment describes the example of using a bidirectional rotary hydraulic pump as the sub-hydraulic pump 7. The sub-hydraulic pump 7 is not limited to the bidirectional rotary hydraulic pump, a unidirectional rotary pump may be used, and any hydraulic pump that can increase the pressure and volume of the pressured liquid supplied the double rod cylinder (hydraulic actuator) 2 by predetermined quantities, respectively, may be used. Furthermore, the embodiment describes the example in which the servo motor 8 is used to drive the sub-hydraulic pump 7. However, this configuration need not be always used, and another electric motor, a conventional known drive means, or the like may be used. Even though a relatively inexpensive electric motor is used in place of the servo motor 8, a capacity is optimally selected depending on an application to make it possible to easily obtain high performance. For example, the hydraulic actuator such as the double rod cylinder 2 is driven by valve control of the main flow line 3 in a high-speed range, and the left and right second valves 5*a* and 5*b* are closed in a low-speed range to configure a closed circuit. When the sub-hydraulic pump 7 is driven, driving at a creeping speed can be achieved. In this manner, a hydraulic drive circuit in which the sub-hydraulic pump 7 is of a bidirectional rotary type or a unidirectional rotary type to obtain a function of a closed circuit by arranging a plurality of valves is not yet developed. In a conventional hydraulic drive circuit, since a plurality of pumps are simply serially coupled to each other, only a pressure-increasing effect can be obtained. However, a configuration like the hydraulic drive circuit 1 is employed to make it possible to improve the responsiveness and the precision of control of a power and a speed in a hydraulic actuator at a low cost with a simple configuration. In selection of the sub-hydraulic pump 7 and the electric motor 8, when minimum performance and a minimum capacity that cover a variation in load are selected, since a small pump has responsiveness higher than that of a large-capacity pump, servo performance higher than that of a one-actuator-and-one-pump type EHA (Electro Hydrostatic Actuator) that intends to cover all the loads can be achieved at a cost considerably lower than that of the EHA.

The sub-hydraulic pump 7, the first valves 4*a* and 4*b*, and the second valves 5*a* and 5*b* are set in a manifold (not shown) and configured as one unit to make it possible to achieve space saving. In the embodiment, although the pressured liquid is discharged from the main hydraulic pump P to the main flow line 3, an optimum accumulator (not shown) may be arranged in consideration of an entire load ratio and the capacity of the sub-hydraulic pump 7 to accumulate the pressure of the pressured liquid discharged from the main hydraulic pump P. In this manner, since a small-capacity pump can be used as the main hydraulic pump P, the apparatus can be reduced in size as a whole. When an electric motor for driving the main hydraulic pump P is of an inverter type or a servo type, the performance can be further improved. The embodiment shows the case in which the double rod cylinder 2 is driven as the hydraulic actuator. However, the configuration need not be always used, and the hydraulic drive circuit 1 can also be applied to another hydraulic actuator such as a single rod cylinder.

An operation performed when the hydraulic drive circuit 1 according to the embodiment is used will be described below with reference to FIG. 1. In general, in the hydraulic drive circuit 1, for example, when the double rod cylinder 2 is driven in the right direction, the left second valve 5*a* is closed, and the right second valve 5*b* is opened. In this state, when the left first valve 4*a* is opened and the right first valve 4*b* is closed, the pressured liquid flows from the left route 31 of the main flow line 3 in which the first valve 4*a* is arranged into the left liquid chamber 21 of the double rod cylinder 2, and returns from the right liquid chamber 22 to the tank T through the second valve 5*b*.

In the hydraulic drive circuit 1, when a power or a speed of the double rod cylinder 2 is desired to be instantaneously increased, in place of control of the pressure or the flow rate of the pressured liquid discharged from the main hydraulic pump P, the bidirectional rotary sub-hydraulic pump 7 arranged in the branched flow line 6 is rotated to the left with the servo motor 8 by a necessary torque and a necessary rotating speed to absorb the pressured liquid flowing in the right route 32 to increase the pressure of the pressured liquid, and the pressured liquid is caused to flow into the pressured liquid flowing in the left route 31 at a branch point before the left first valve 4*a*. With this operation, the pressured liquid flowing in the left route 31 is increased in pressure and volume and can be supplied into the left liquid chamber 21 of the double rod cylinder 2. When the double rod cylinder 2 is driven in the left direction, in an open circuit configuration, the left first valve 4*a* is closed, and the right first valve 4*b* is opened. In this state, the sub-hydraulic pump 7 is rotated to the right with the servo motor 8 by a necessary torque and a necessary rotating speed to absorb the pressured liquid flowing in the left route 31 to increase the pressure of the pressured liquid, and the pressured liquid may be caused to flow into the pressured liquid flowing in the right route 32 at a branch point before the right first valve 4*b*. In each case, when the sub-hydraulic pump 7 is rotated with the servo motor 8 by a necessary torque and a necessary rotating speed, the pressured liquid can be increased in pressure and volume. As the sub-hydraulic pump 7, for example, a unidirectional (left) rotary hydraulic pump may be used to absorb the pressured liquid flowing in the right route 32 to increase the pressure of the pressured liquid, and the pressured liquid is caused to flow into the pressured liquid flowing in the left route 31, and the right route 32 may be configured to control the pressure and the flow rate of the pressured liquid discharged from the main hydraulic pump P.

The hydraulic drive circuit 1*a* according to a second embodiment of the present invention will be described below with reference to FIG. 2. The same reference numerals as in the hydraulic drive circuit 1 according to the first embodiment denote the same configurations or the like in the hydraulic drive circuit 1*a* according to the second embodiment, and a detailed description thereof will not be made.

Figure 2:
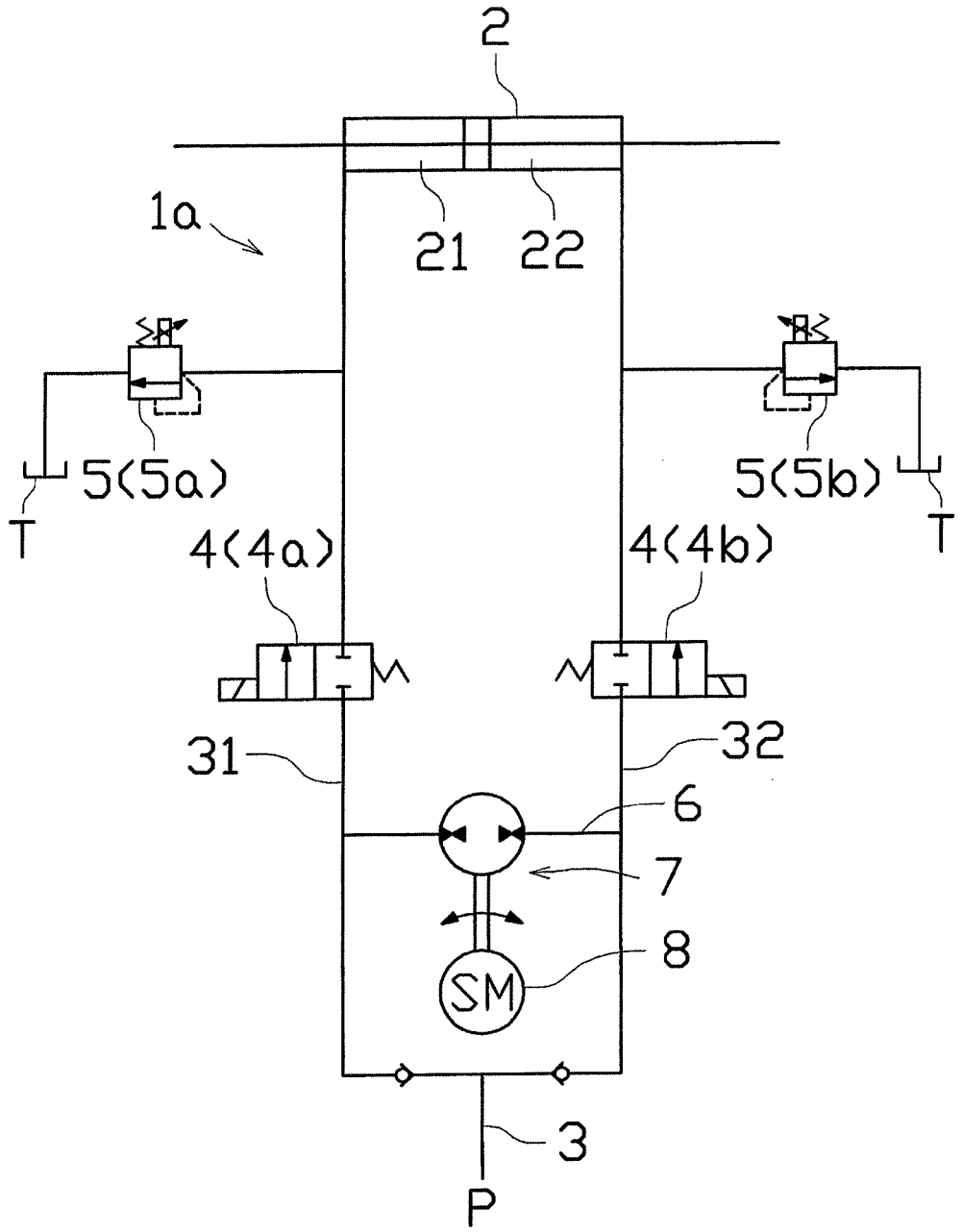
FIG. 2 is a hydraulic circuit diagram schematically showing a configuration according to a second embodiment of the present invention.

The hydraulic drive circuit 1*a*, as shown in FIG. 2, includes left and right electromagnetic direction control valves (first valves) 4*a* and 4*b* arranged in the main flow line 3 that branches pressured liquid discharged from the main hydraulic pump P in two directions and circulates the pressured liquid into the liquid chambers 21 and 22 of the double rod cylinder 2, left and right electromagnetic relief valves (second valves) 5*a* and 5*b* that adjust a pressure in the main flow line 3 to return pressured liquid discharged from the double rod cylinder 2 to the tank T, and the bidirectional rotary sub-hydraulic pump 7 arranged between the main hydraulic pump P and the electromagnetic direction control valves 4*a* and 4*b* in the branched flow line 6 branched from the main flow line 3. In the hydraulic drive circuit 1*a*, although not shown in detail, the servo motor 8 to rotationally drive the sub-hydraulic pump 7, a computer control circuit to control operations of various valves or the like, a manual operational circuit, various sensors such as a pressure sensor, and the like are arbitrarily arranged.

In the hydraulic drive circuit 1*a*, the left and right electromagnetic direction control valves 4 (4*a* and 4*b*) are used as the first valves to switch the drive states of the double rod cylinder 2, and the left and right electromagnetic relief valves 5 (5*a* and 5*b*) are used as the second valves to return the pressured liquid discharged from the double rod cylinder 2 to the tank. Also in the embodiment, in place of the servo motor 8 used to drive the sub-hydraulic pump 7, another electric motor, a conventional known drive means, or the like may be used. Even though a relatively inexpensive electric motor is used in place of the servo motor 8, a capacity is optimally selected depending on an application to make it possible to easily achieve high performance. For example, the hydraulic actuator such as the double rod cylinder 2 is driven by valve control of the main flow line 3 in a high-speed range, and the left and right electromagnetic relief valves 5*a* and 5*b* are closed in a low-speed range to configure a closed circuit. When the sub-hydraulic pump 7 is driven, driving at a creeping speed can be achieved. The sub-hydraulic pump 7, the electromagnetic direction control valves 4*a* and 4*b*, and the electromagnetic relief valves 5*a* and 5*b* are set in a manifold (not shown) and configured as one unit to make it possible to achieve space saving. The case in which the double rod cylinder 2 is driven as a hydraulic actuator in the hydraulic drive circuit 1*a* is described. However, the configuration need not be always used, like the hydraulic drive circuit 1, the hydraulic drive circuit 1*a* can also be applied to a hydraulic actuator such as a single rod cylinder.

An operation performed when the hydraulic drive circuit 1*a* according to the embodiment is used will be described below with reference to FIG. 2. In general, in the double rod cylinder 2, the pressure of the main flow line 3 is adjusted with the electromagnetic relief valves 5*a* and 5*b*, and valve control is performed with pressured liquid discharged from the main hydraulic pump P. For example, when the double rod cylinder 2 is driven in the right direction, in a state in which the pressure of the main flow line 3 is adjusted with the electromagnetic relief valves 5*a* and 5*b*, the left electromagnetic direction control valve 4*a* is opened, and the right electromagnetic direction control valve 4*b* is closed. In this state, the pressured liquid flows from the left main flow line 31 into the left liquid chamber 21 of the double rod cylinder 2, and the pressured liquid returns from the right liquid chamber 22 to the tank T through the electromagnetic relief valve 5*b*.

In the hydraulic drive circuit 1*a*, when a power or a speed of the double rod cylinder 2 is desired to be instantaneously increased, in place of control of the pressure and the flow rate of the pressured liquid discharged from the main hydraulic pump P, the bidirectional rotary sub-hydraulic pump 7 arranged in the branched flow line 6 is rotated to the left with the servo motor 8 by a necessary torque and a necessary rotating speed to absorb the pressured liquid flowing in the right route 32 to increase the pressure of the pressured liquid, and the pressured liquid is caused to flow into the pressured liquid flowing in the left route 31 at a branch point before the left electromagnetic direction control valve 4*a*. With this operation, the pressured liquid flowing in the left route 31 is increased in pressure and volume and can be supplied into the left liquid chamber 21 of the double rod cylinder 2. When the double rod cylinder 2 is driven in the left direction, in an open circuit configuration, the left electromagnetic direction control valve 4*a* is closed, and the right electromagnetic direction control valve 4*b* is opened. In this state, the sub-hydraulic pump 7 is rotated to the right with the servo motor 8 by a necessary torque and a necessary rotating speed to absorb the pressured liquid flowing in the left route 31 to increase the pressure of the pressured liquid, and the pressured liquid may be caused to flow into the pressured liquid flowing in the right route 32 at a branch point before the right electromagnetic direction control valve 4*b*. In each case, when the sub-hydraulic pump 7 is rotated with the servo motor 8 by a necessary torque and a necessary rotating speed, the pressured liquid can be increased in pressure and volume.

A hydraulic drive circuit 1*b* according to a third embodiment of the present invention will be described below with reference to FIG. 3. The same reference numerals as in the hydraulic drive circuits 1 and 1*a* according to the first and second embodiments denote the same configurations or the like in the hydraulic drive circuit 1*b* according to the third embodiment, and a detailed description thereof will not be made.

Figure 3:
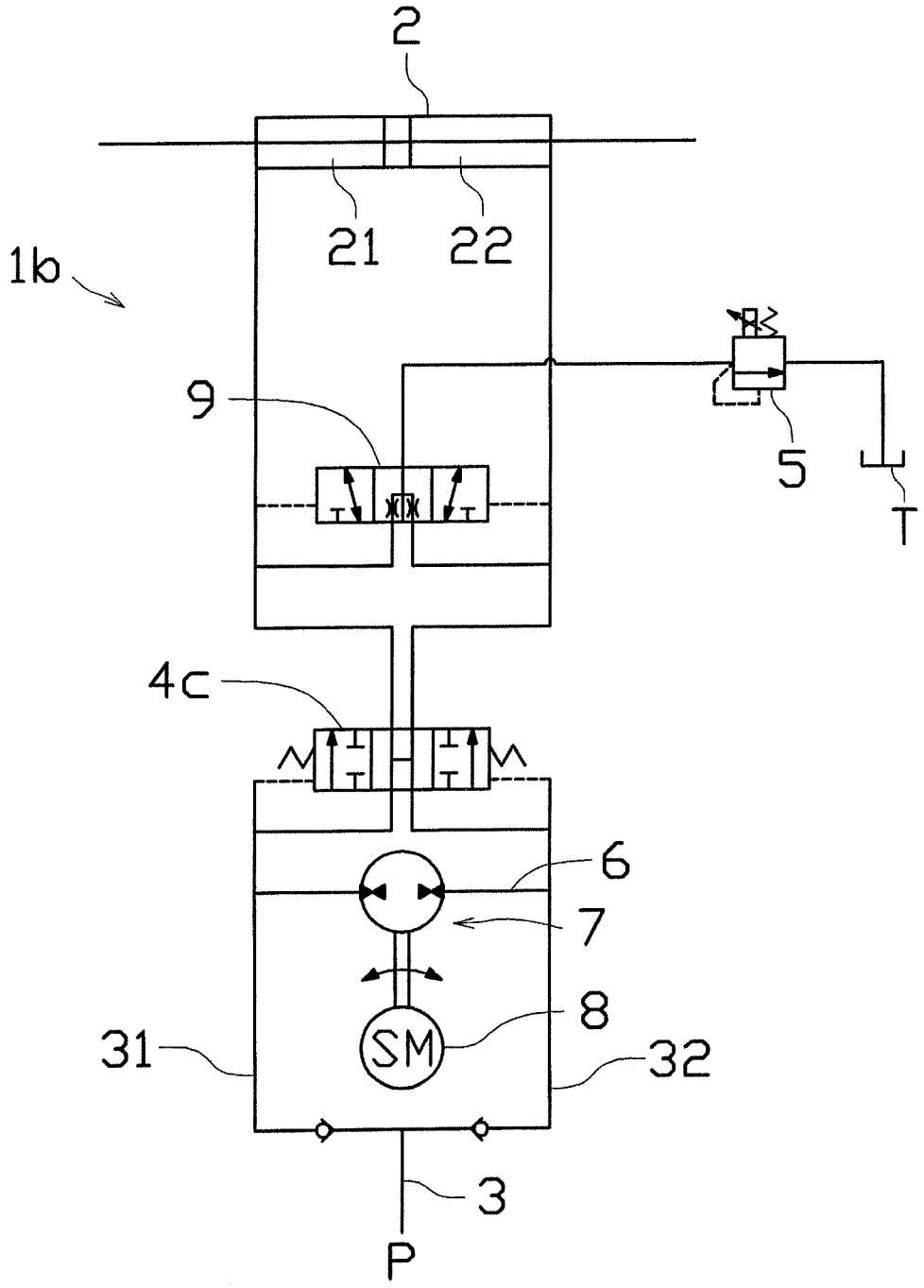
FIG. 3 is a hydraulic circuit diagram schematically showing a configuration according to a third embodiment of the present invention.

The hydraulic drive circuit 1*b*, as shown in FIG. 3, includes a pilot direction control valve (first valve) 4*c* arranged in the main flow line 3 that branches pressured liquid discharged from the main hydraulic pump P in two directions and circulates the pressured liquid into the liquid chambers 21 and 22 of the double rod cylinder 2, a pilot direction control valve 9 arranged between the pilot direction control valve 4*c* and the double rod cylinder 2 to cause the pressured liquid to flow into one of the liquid chambers of the double rod cylinder 2 and to cause the pressured liquid discharged from the other liquid chamber to flow into the tank T, an electromagnetic relief valve (second valve) 5 that adjusts a pressure of the main flow line 3 to return pressured liquid flowing through the pilot direction control valve 9 to the tank T, and the bidirectional rotary sub-hydraulic pump 7 arranged between the main hydraulic pump P and the pilot direction control valve 4*c* in the branched flow line 6 branched from the main flow line 3. In the hydraulic drive circuit 1*b*, the two electromagnetic direction control valves 4*a* and 4*b* functioning as the first valves shown in FIG. 2 are replaced with one pilot direction control valve 4*c*, the pilot direction control valve 9 is arranged between the pilot direction control valve 4*c* and the double rod cylinder 2, and one electromagnetic relief valve 5 is arranged at the outlet port to the tank T. In the hydraulic drive circuit 1*b*, although not shown in detail, the servo motor 8 to rotationally drive the sub-hydraulic pump 7, a computer control circuit to control operations of various valves or the like, a manual operational circuit, various sensors such as a pressure sensor, and the like are arbitrarily arranged.

The pilot direction control valve 4*c* switches a flow direction of the pressured liquid flowing from the main flow line 3 to the double rod cylinder 2 to the left or the right due to a difference between left and right pilot pressures to switch drive states (drive in the left or right direction) of the double rod cylinder 2. Also in the embodiment, in place of the servo motor 8 used to drive the sub-hydraulic pump 7, another electric motor, a conventional known driving means, or the like may be used. Even though a relatively inexpensive electric motor is used in place of the servo motor 8, a capacity is optimally selected depending on an application to make it possible to easily achieve high performance. For example, a hydraulic actuator such as the double rod cylinder 2 is driven by valve control of the main flow line 3 in a high-speed range, and the electromagnetic relief valve 5 is closed in a low-speed range to configure a closed circuit. When the sub-hydraulic pump 7 is driven, driving at a creeping speed can be achieved. The sub-hydraulic pump 7, the pilot direction control valve 4*c*, a pilot direction control valve 9, and the electromagnetic relief valve 5 may be set in a manifold (not shown) and configured as one unit. The case in which the double rod cylinder 2 is driven as the hydraulic actuator in the hydraulic drive circuit 1*b* is described. However, the configuration need not be always used, like the hydraulic drive circuit 1, the hydraulic drive circuit 1*b* can be also applied to another hydraulic actuator such as a single rod cylinder.

An operation performed when the hydraulic drive circuit 1*b* according to the embodiment is used will be described below with reference to FIG. 3. In general, in the double rod cylinder 2, valve control is performed with pressured liquid generated from the main hydraulic pump P. In a neutral state, a pressure in the main flow line 3 is kept at a value set by the electromagnetic relief valve 5, and the double rod cylinder 2 is applied with a resistance corresponding to a throttle at the center of the pilot direction control valve 9.

When the double rod cylinder 2 is desired to be moved in the right direction in this state, a necessary back pressure is applied to the double rod cylinder 2 by the electromagnetic relief valve 5, and the sub-hydraulic pump 7 is rotated to the left with the servo motor 8. At this time, the left and right pilot pressures of the pilot direction control valve 4*c* are different from each other to move a spool to the right. In this manner, pressured liquid discharged from the main hydraulic pump P flows into the left liquid chamber 21 of the double rod cylinder 2 through the left route 31 of the main flow line 3. At the same time, the left and right pilot pressures of the pilot direction control valve 9 are different from each other, and a spool of the pilot direction control valve 9 moves to the right. In this manner, the pressured liquid pushed out of the right liquid chamber 22 of the double rod cylinder 2 flows into the tank T through the pilot direction control valve 9. Similarly, the double rod cylinder 2 is desired to be driven in the left direction, the servo motor 8 need only be rotated in the reverse direction. In each case, when the sub-hydraulic pump 7 is rotated with the servo motor 8 by a necessary torque and a necessary rotating speed, the pressured liquid can be increased in pressure and volume.

A hydraulic drive circuit 1*c* according to a fourth embodiment of the present invention will be described below with reference to FIG. 4. The same reference numerals as in the hydraulic drive circuits 1 to 1*b* according to the first to third embodiments denote the same configurations or the like in the hydraulic drive circuit 1*c* according to the fourth embodiment, and a detailed description thereof will not be made.

Figure 4:
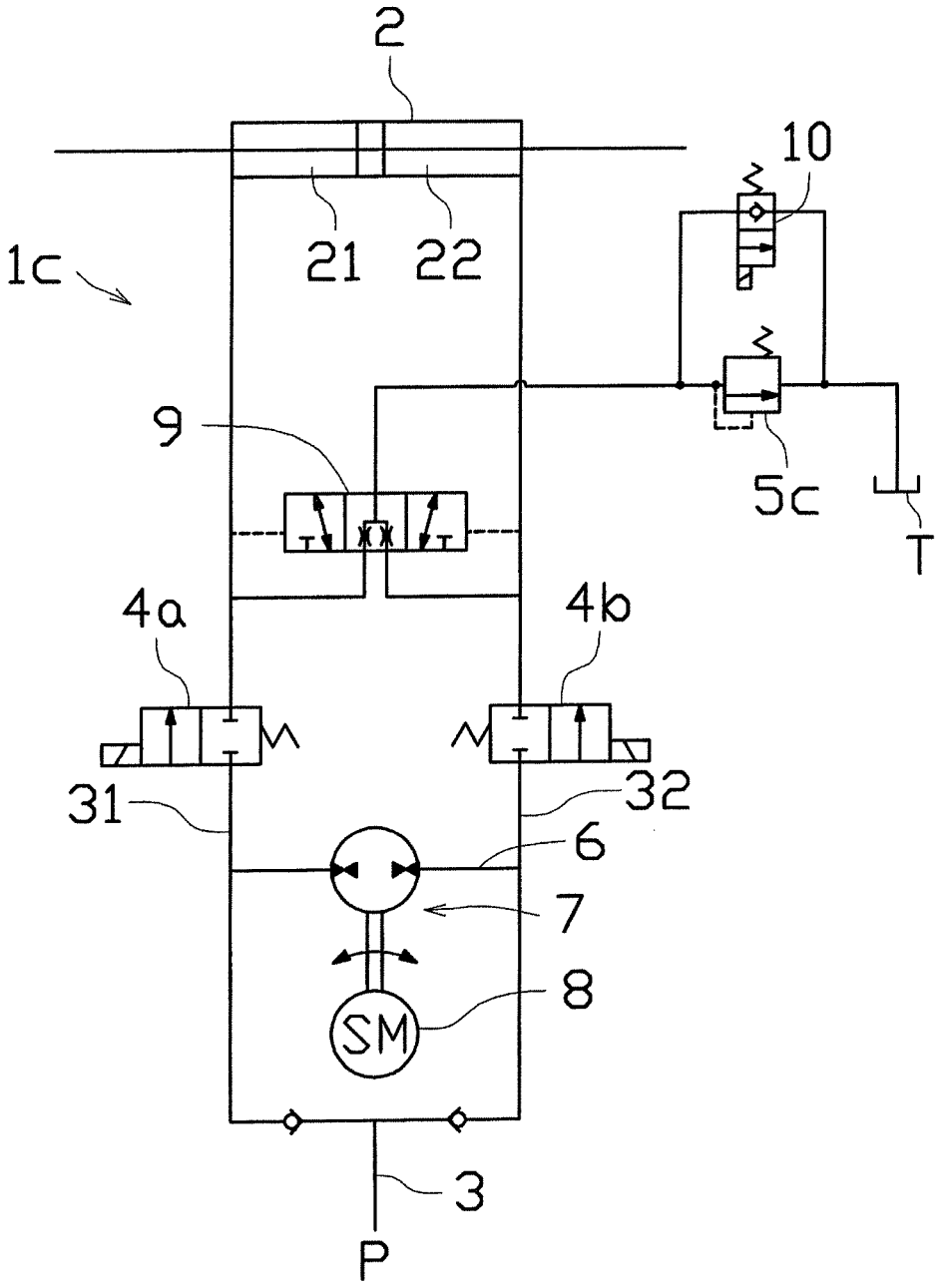
FIG. 4 is a hydraulic circuit diagram schematically showing a configuration according to a fourth embodiment of the present invention.

The hydraulic drive circuit 1*c*, as shown in FIG. 4, includes left and right electromagnetic direction control valves 4*a* and 4*b* arranged in the main flow line 3 that branches pressured liquid discharged from the main hydraulic pump P in two directions and circulates the pressured liquid into the liquid chambers 21 and 22 of the double rod cylinder 2, the pilot direction control valve 9 arranged between the electromagnetic direction control valves (first valves)) 4*a* and 4*b* and the double rod cylinder 2 such that the pressured liquid is caused to flow into one of the liquid chambers of the double rod cylinder 2 and returns the pressured liquid discharged from the other liquid chamber to the tank T, a relief valve (second valve) 5*c* to adjust a pressure of the main flow line 3, an electromagnetic direction control valve 10 arranged at the outlet port of the tank T, and the bidirectional rotary sub-hydraulic pump 7 arranged between the main hydraulic pump P and the electromagnetic direction control valves 4*a* and 4*b* in the branched flow line 6 branched from the main flow line 3. In the hydraulic drive circuit 1*c*, as in the hydraulic drive circuit 1 in FIG. 2, the electromagnetic direction control vales 4*a* and 4*b* functioning as first valves are arranged in the left route 31 and the right route 32 of the main flow line 3, respectively. When the electromagnetic direction control valves 4*a* and 4*b* are opened or closed to adjust a flow rate of pressured liquid supplied from the main flow line 3 to the double rod cylinder 2. The case in which double rod cylinder 2 is driven as the hydraulic actuator in the hydraulic drive circuit 1*c* is described. However, the configuration need not be always used, like the hydraulic drive circuit 1, the hydraulic drive circuit 1*c* can be also applied to another hydraulic actuator such as a single rod cylinder.

An operation performed when the hydraulic drive circuit 1*c* according to the embodiment is used will be described below with reference to FIG. 4. In general, in the double rod cylinder 2, a pressure of the main flow line 3 is adjusted by the relief valve 5*c*, and valve control is performed by pressured liquid generated from the main hydraulic pump P. For example, when the double rod cylinder 2 is desired to be driven in the right direction, in an open circuit configuration in which the electromagnetic direction control valve 10 is opened, the left electromagnetic direction control valve 4*a* is opened, and the right electromagnetic direction control valve 4*b* is closed. At this time, due to a pressure difference, a spool of the pilot direction control valve 9 moves to the right. In this manner, the pressured liquid flows into the left liquid chamber 21 of the double rod cylinder 2 and returns from the right liquid chamber 22 into the tank T through the pilot direction control valve 9 and the electromagnetic direction control valve 10.

In the hydraulic drive circuit 1*c*, when the power or the speed of the double rod cylinder 2 is desired to be instantaneously increased, in place of control of the pressure or the flow rate of pressured liquid discharged from the main hydraulic pump P, the bidirectional rotary sub-hydraulic pump 7 arranged in the branched flow line 6 is rotated to the left with the servo motor 8 by a necessary torque and a necessary rotating speed to absorb the pressured liquid flowing in the right route 32 of the main flow line 3 to increase the pressure of the pressured liquid, and the pressured liquid is caused to flow into the pressured liquid flowing in the left route 31 of the main flow line 3 at a branch point before the left electromagnetic direction control valve 4*a*. With this operation, the pressured liquid flowing in the left route 31 is increased in pressure and volume and can be supplied into the left liquid chamber 21 of the double rod cylinder 2. When the double rod cylinder 2 is driven in the left direction, in an open circuit configuration, the left electromagnetic direction control valve 4*a* is closed, and the right electromagnetic direction control valve 4*b* is opened. In this state, the sub-hydraulic pump 7 is rotated to the right with the servo motor 8 by a necessary torque and a necessary rotating speed to absorb the pressured liquid flowing in the left route 31 of the main flow line 3 to increase the pressure of the pressured liquid, and the pressured liquid may be caused to flow into the pressured liquid flowing in the right route 32 of the main flow line 3 at a branch point before the right electromagnetic direction control valve 4*b*.

When the electromagnetic direction control valve 10 is closed while the electromagnetic direction control valves 4*a* and 4*b* are kept open, the double rod cylinder 2 can be driven with a closed circuit configuration using the sub-hydraulic pump 7 at an arbitrary point of time. In this case, although energy of the pressured liquid discharged from the main hydraulic pump P is shielded, the hydraulic drive circuit is not influenced by disturbance. For this reason, the hydraulic drive circuit is especially useful to minute force control and creeping-speed control.

A hydraulic drive circuit 1*d* according to a fifth embodiment of the present invention will be described below with reference to FIG. 5. The same reference numerals as in the hydraulic drive circuits 1 to 1*c* according to the first to fourth embodiments denote the same configurations or the like in the hydraulic drive circuit 1*d* according to the fifth embodiment, and a detailed description thereof will not be made.

The hydraulic drive circuit 1*d* is configured as a multiaxis distribution control circuit such that the plurality of double rod cylinders (hydraulic actuators) 2 and the plurality of sub-hydraulic pumps 7 are connected to one main flow line 3*a* to cover an average load of the entire system with energy of pressured liquid discharged from the main hydraulic pump P to the main flow line 3*a* and to cover a difference between the load of the double rod cylinder 2 and the average load of the entire system with energy generated by the bidirectional rotary sub-hydraulic pump 7.

Figure 5:
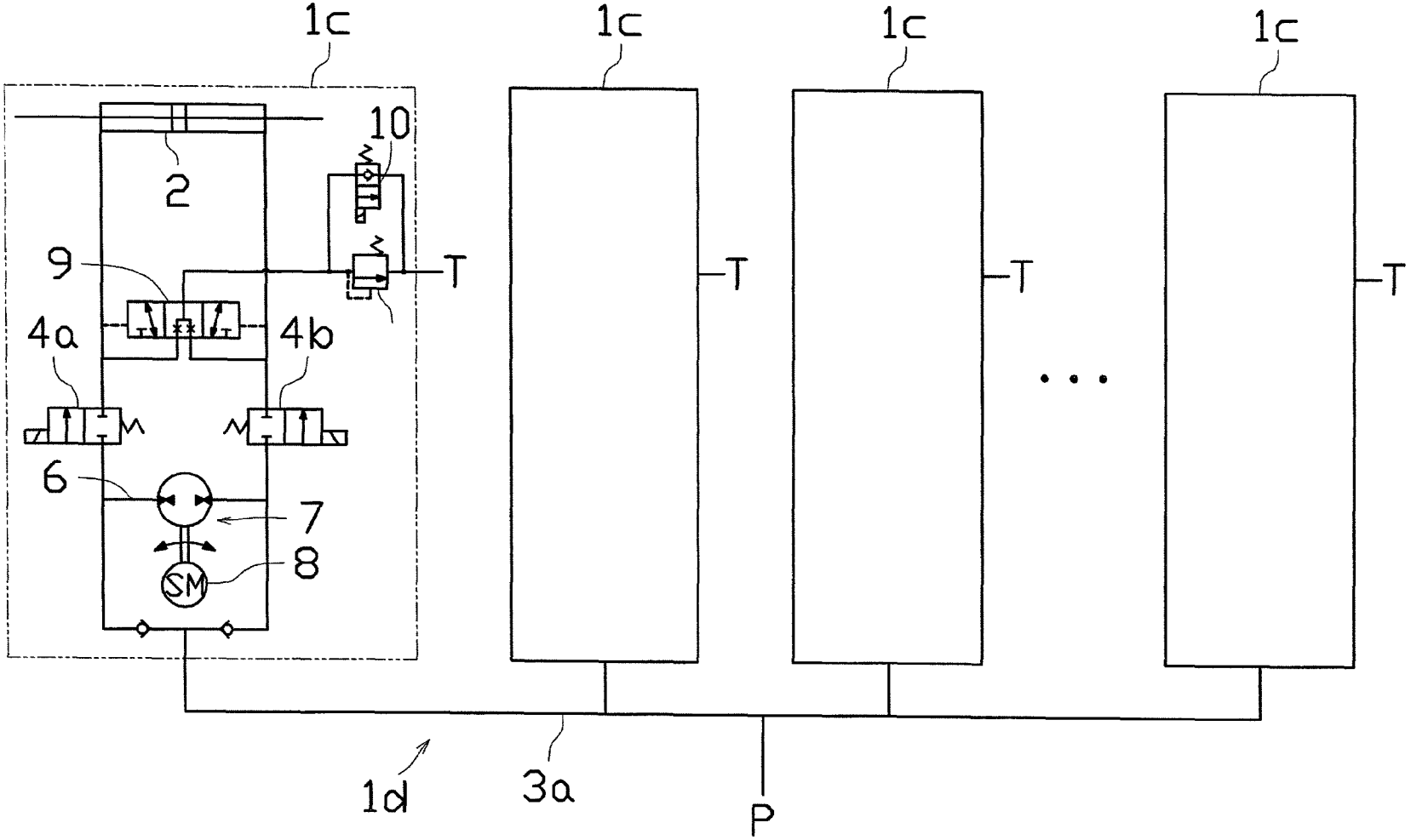
FIG. 5 is a hydraulic circuit diagram schematically showing a configuration according to a fifth embodiment of the present invention.

The hydraulic drive circuit 1*d*, as shown in FIG. 5, includes the plurality of hydraulic drive circuits 1*c* shown in FIG. 4. The main flow line 3*a* is branched to circulate the pressured liquid discharged from the main hydraulic pump P to the respective hydraulic drive circuits 1*c*. The hydraulic drive circuit 1*d* can be effectively used in a drive system for a construction machine or the like. In FIG. 5, the configurations of some of the plurality of hydraulic drive circuits 1*c* configuring the hydraulic drive circuit 1*d* are not shown. The example in which the multiaxis distribution control circuit is configured by using the plurality of hydraulic drive circuit 1*c* in the hydraulic drive circuit 1*d* is described. However, the multiaxis distribution control circuit may be configured by using other hydraulic drive circuits 1 to 1*b*. The case in which the double rod cylinder 2 is driven as a hydraulic actuator also in the hydraulic drive circuit 1*d* is described. However, the configuration need not be always used, and the hydraulic drive circuit 1*d* can also be applied to another hydraulic actuator such as a single rod cylinder.

The embodiments of the present invention are not limited to the embodiments described above, and the present invention can be arbitrarily changed and modified without departing from the spirit and scope of the present invention.

DESCRIPTION OF REFERENCE SIGNS

1, 1*a* to 1*d*: Hydraulic drive circuit
2: Double rod cylinder (hydraulic actuator)
21, 22: Liquid chamber
3, 3*a*: Main flow line
4, 4*a* to 4*c*: First valve
5, 5*a* to 5*c*: Second valve
6: Branched flow line
7: Sub-hydraulic pump
8: Servo motor (electric motor)
9: Pilot direction control valve
10: Electromagnetic direction control valve
P: Main hydraulic pump
T: Tank

The invention claimed is:

1. A hydraulic drive circuit having a main hydraulic pump driven with a first motor and a hydraulic actuator, the hydraulic actuator being driven by supplying pressured liquid discharged from the main hydraulic pump, the hydraulic drive circuit comprising:

first valves of which one is arranged in a left route of a main flow line between the main hydraulic pump and a left liquid chamber of the hydraulic actuator and another is arranged in a right route of the main flow line between the main hydraulic pump and a right liquid chamber of the hydraulic actuator to branch the pressured liquid discharged from the main hydraulic pump in two directions and circuit the pressured liquid to the left and right liquid chambers of the hydraulic actuator respectively, for adjusting a flow rate of the pressured liquid supplied from the main flow line into one of the left and right liquid chambers of the hydraulic actuator to drive the hydraulic actuator;

second valves of which one is arranged in a route between the left liquid chamber of the hydraulic actuator and a tank and another is arranged in a route between the right liquid chamber of the hydraulic actuator and the tank to return the pressured liquid discharged from the hydraulic actuator to the tank; and a sub-hydraulic pump that is arranged between the main hydraulic pump and the first valves in a branched flow line branched from the main flow line and uses the pressured liquid flowing in the branched flow line to increase a pressure and a volume of the pressured liquid supplied from the main flow line to the hydraulic actuator by predetermined quantities by being driven with a second motor different from the first motor;

wherein each of the second valves is closed to configure a closed circuit, wherein one of the second valves arranged in the route from one of the liquid chambers into which the pressured liquid flows from the main hydraulic pump to the tank is closed and the other second valve arranged in the route from the other liquid chamber from which the pressured liquid is discharged to the tank is opened to configure an open circuit, and wherein the sub-hydraulic pump in a state that one of the first valves arranged in one of the routes from the main hydraulic pump to one of the liquid chambers into which the pressured liquid flows is opened and the other first valve arranged in the other route from the other liquid chamber from which the pressured liquid is discharged to the main hydraulic pump is closed in the open circuit configuration absorbs the pressured liquid flowing in the other route and flows the absorbed pressured liquid into the pressure liquid flowing in one of the routes at a branch point before one of the first valves so as to supply the pressured liquid to one of the liquid chambers of the hydraulic actuator by increasing a pressure and a volume of the pressured liquid flowing in one of the routes and drive the hydraulic actuator.

2. A hydraulic drive circuit comprising:

a plurality of hydraulic drive circuits each of which is recited in claim 1, wherein the main flow line is branched to circulate pressured liquid discharged from the main hydraulic pump to the respective hydraulic drive circuits.

* * * * *